US009085184B2

(12) United States Patent
Wanibe

(10) Patent No.: US 9,085,184 B2
(45) Date of Patent: Jul. 21, 2015

(54) PRINTING APPARATUS

(71) Applicant: SEIKO EPSON CORPORATION, Tokyo (JP)

(72) Inventor: Akihisa Wanibe, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/222,009

(22) Filed: Mar. 21, 2014

(65) Prior Publication Data

US 2014/0292925 A1 Oct. 2, 2014

(30) Foreign Application Priority Data

Mar. 26, 2013 (JP) ..... 2013-063550

(51) Int. Cl.

| | |
|---|---|
| ***B41J 23/00*** | (2006.01) |
| ***B41J 25/308*** | (2006.01) |
| ***B41J 25/00*** | (2006.01) |
| ***B41J 2/165*** | (2006.01) |

(52) U.S. Cl.

CPC ..... *B41J 25/001* (2013.01); *B41J 2/16535* (2013.01)

(58) Field of Classification Search

USPC ..... 347/8, 37

See application file for complete search history.

(56) References Cited

U.S. PATENT DOCUMENTS 8,118,394 B2 2/2012 Suzuki et al.
2009/0284566 A1* 11/2009 Suzuki et al. ..... 347/38

FOREIGN PATENT DOCUMENTS

JP 2009-274285 11/2009

* cited by examiner

*Primary Examiner* — Stephen Meier
*Assistant Examiner* — Alexander D Shenderov
(74) *Attorney, Agent, or Firm* — Workman Nydegger

(57) ABSTRACT

A carriage moving mechanism has a first guiding mechanism that guides, in a discharging direction Z, a movement of a carriage relative to a frame member, a second guiding mechanism that is arranged at a position different from the first guiding mechanism and guides, in the discharging direction, the movement of the carriage relative to the frame member, and a driving mechanism that drives the carriage in the discharging direction, in which a distance by which the carriage is able to move at a non-printing position through the use of the second guiding mechanism, relative to a positioning position is greater than a distance by which the carriage is able to move through the use of the first guiding mechanism and the second guiding mechanism in the printing position, relative to the positioning position.

6 Claims, 8 Drawing Sheets

IN PRINTING

IN MAINTENANCE

IN PRINTING

IN MAINTENANCE

PRINTING APPARATUS

BACKGROUND

1. Technical Field

The present invention relates to a printing apparatus in which liquid is discharged through a head held in a carriage, and thus an image is printed on a recording medium.

2. Related Art

In recent years, a printing apparatus, such as an ink jet printer, in which liquid is discharged through nozzles of a head in a state where the head faces a supporting member that supports a recording medium, and thus an image is printed on the recording medium has been known. Generally, in such a printing apparatus, not only a printing operation described above can be performed but also maintenance, such as elimination of nozzle clogging, can be performed on the head by a maintenance unit.

To perform high-quality printing of a printing apparatus, it is necessary to position each head at a position, that is, a vertical position, predetermined relative to the supporting member in a liquid discharging direction. In addition, when maintenance is performed, it is necessary to position the head at a vertical position suitable for performing the maintenance. For this reason, the printing apparatus of the related art is equipped with a unit which regulates a vertical position of the head by moving the head in an up-down direction. In an apparatus disclosed in, for example, JP-A-2009-274285, guiding mechanisms are respectively provided on both longitudinal end portions of a head holder (corresponding to a "carriage" according to an aspect of the invention) and a head can move in an up-down direction, relative to the head holder. More specifically, the apparatus described above is configured as follows.

In the apparatus disclosed in JP-A-2009-274285, the guiding mechanisms having the same configuration are respectively provided on the end portions such that the head holder is pinched between both longitudinal end portions. Each guiding mechanism has two guide rails which are installed in a superimposed state. One of the guide rails is fixed to the head holder and the other guide rail supports the head and is slidable along the one guide rail. When a stepping motor is operated, the other guide rail moves along one guide rail, and thus the head moves and is positioned.

To perform favorable printing, high-accuracy positioning is required for a head. Thus, it is necessary to use a high-precision guide rail. Therefore, in the case of the apparatus disclosed in JP-A-2009-274285, it is necessary to use high-precision guide rails as both guiding mechanisms. As a result, the following problems may be caused. As the precision of the guiding mechanism increases, precision at a high level, for example, at a level of several μm, is required for a mounting process. Accordingly, it is necessary for both longitudinal end portions of the head holder to satisfy the requirement described above. When at least either of the longitudinal end portions does not satisfy the requirement described above, stress, such as torsion and tilting, acting in a direction other than an operation direction is caused due to the guiding mechanisms, both of which have a high positioning accuracy. Thus, there is possibility that a movement operation of the head may become heavy or, in the worst case, the guiding mechanism may be damaged. Accordingly, it is necessary for all components on which the guiding mechanism is installed to have very high surface accuracy, positional accuracy, or the like, and this is one of the main factors of an increase in cost.

SUMMARY

An advantage of some aspects of the invention is to provide a printing apparatus of which a head is moved and positioned by two guiding mechanisms, in which high positioning accuracy is achieved at a printing position and high accuracy is not required, at a non-printing position, for a component on which the guiding mechanism is installed.

According to an aspect of the invention, there is provided a printing apparatus that includes a supporting member that supports a recording medium, a head that discharges liquid onto the recording medium that is supported by the supporting member, a carriage that holds the head, a frame member that movably supports the carriage, and a carriage moving mechanism that moves the carriage between a printing position at which printing is performed by the head and a non-printing position which is different from the printing position, in which the carriage moving mechanism has a first guiding mechanism that guides the movement of the carriage relative to the frame member, a second guiding mechanism that is arranged at a position different from that of the first guiding mechanism and guides the movement of the carriage relative to the frame member, and a driving mechanism that drives the carriage in the movement direction, and in which a distance, by which the carriage is able to move at the non-printing position through the use of the second guiding mechanism, relative to a positioning position is greater than a distance, by which the carriage is able to move through the use of the first guiding mechanism and the second guiding mechanism in the printing position, relative to the positioning position.

In this case, the carriage holding the head is moved by two guiding mechanisms, and thus positioning of the head is performed. However, the distance, by which the carriage is able to move through the use of the second guiding mechanism, relative to the positioning position is different in a case where the carriage is located at the printing position and a case where the carriage is located at the non-printing position. In other words, it is possible to say that the distance by which the carriage is able to move relative to the positioning position is a permissible amount by the positioning accuracy. That is, upon comparison between the case where the carriage is located at the printing position and the case where the carriage is located at the non-printing position, accuracy with which the carriage is positioned at the printing position through the use of second guiding mechanism is higher than accuracy with which the carriage is positioned at the non-printing position through the use of second guiding mechanism. Accordingly, when the carriage is located at the printing position, the carriage is positioned with a high level of accuracy, and thus the head held in the carriage can be positioned at the desired position. Furthermore, when the carriage is located at the non-printing position, positioning accuracy is not required as much as in the case where the carriage is located at the printing position. Therefore, a permissible amount by accuracy with which the carriage is positioned at the non-printing position through the use of second guiding mechanism is set to be greater than a permissible amount by accuracy with which the carriage is positioned through the use of the first guiding mechanism and the second guiding mechanism in the printing position. Accordingly, in a case where the carriage is located at the non-printing position, even when the surface accuracy or the positional accuracy of the carriage does not satisfy accuracy required for the use of the first guiding mechanism, the accuracy difference can be absorbed by the second guiding mechanism. Therefore, the accuracy required for assembling or the component accuracy can be reduced, and thus the apparatus can be prevented from increasing in cost.

In the printing apparatus, it is preferable that the first guiding mechanism have a first guide member which is fixed to one of the carriages and the frame member and guides a movement of the carriage in a liquid discharging direction and a second guide member which is fixed to the other carriage and the frame member and which is movable in the discharging direction in a state where the second guide member is engaged with the first guide member, relative to the first guide member, and that the second guiding mechanism have a third guide member which is fixed to one of the carriages and the frame member and guides a movement of the carriage in the discharging direction and a fourth guide member which is fixed to the other carriage and the frame member and which is movable in the discharging direction in a state where the fourth guide member is engaged with the third guide member, relative to the third guide member. In the printing apparatus, as is well known, an inserting/removing operation of the head relative to the carriage or a maintenance operation, for example, may be performed in a state where the carriage is positioned at the non-printing position. Thus, in some cases, an external force may apply to the head or the carriage. For this reason, it is preferable that the third guide member have a spring portion having a spring-like property and the fourth guide member be engaged with the spring portion when the carriage is positioned at the non-printing position. The printing apparatus is configured as described above, and thus the external force which is applied to the head or the carriage is absorbed. Therefore, the head or the carriage can be prevented from being greatly deviated from an initial position thereof, and thus it is possible to effectively prevent a failure or damage of the apparatus from occurring.

In the printing apparatus described above, it is preferable that the third guide member have a rigid portion having a spring-like property lower than that of the spring portion and the fourth guide member be engaged with the rigid portion when the carriage is positioned at the printing position. In this case, positional deviation of the carriage is prevented from occurring during the printing operation, and thus it is possible to perform printing processes in a state where the head is stationary. As a result, it is possible to perform printing with a high level of accuracy.

Furthermore, in the printing apparatus described above, it is preferable that the first guide member be constituted by a linear rail that extends in the discharging direction and the second guide member be constituted by a slider that moves along the linear rail. That is, the first guiding mechanism may be a linear guide. In this case, it is possible to significantly improve the positioning accuracy of the carriage by the first guiding mechanism.

A fixing aspect of the guide member to the carriage is optional. For example, it is preferable that a fixing surface on the carriage, to which one of the first guide member and the second guide member is fixed, and a fixing surface on the carriage, to which the one of the third guide member and the fourth guide member is fixed, be the same. Alternatively, the fixing surfaces described above may be different from each other.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
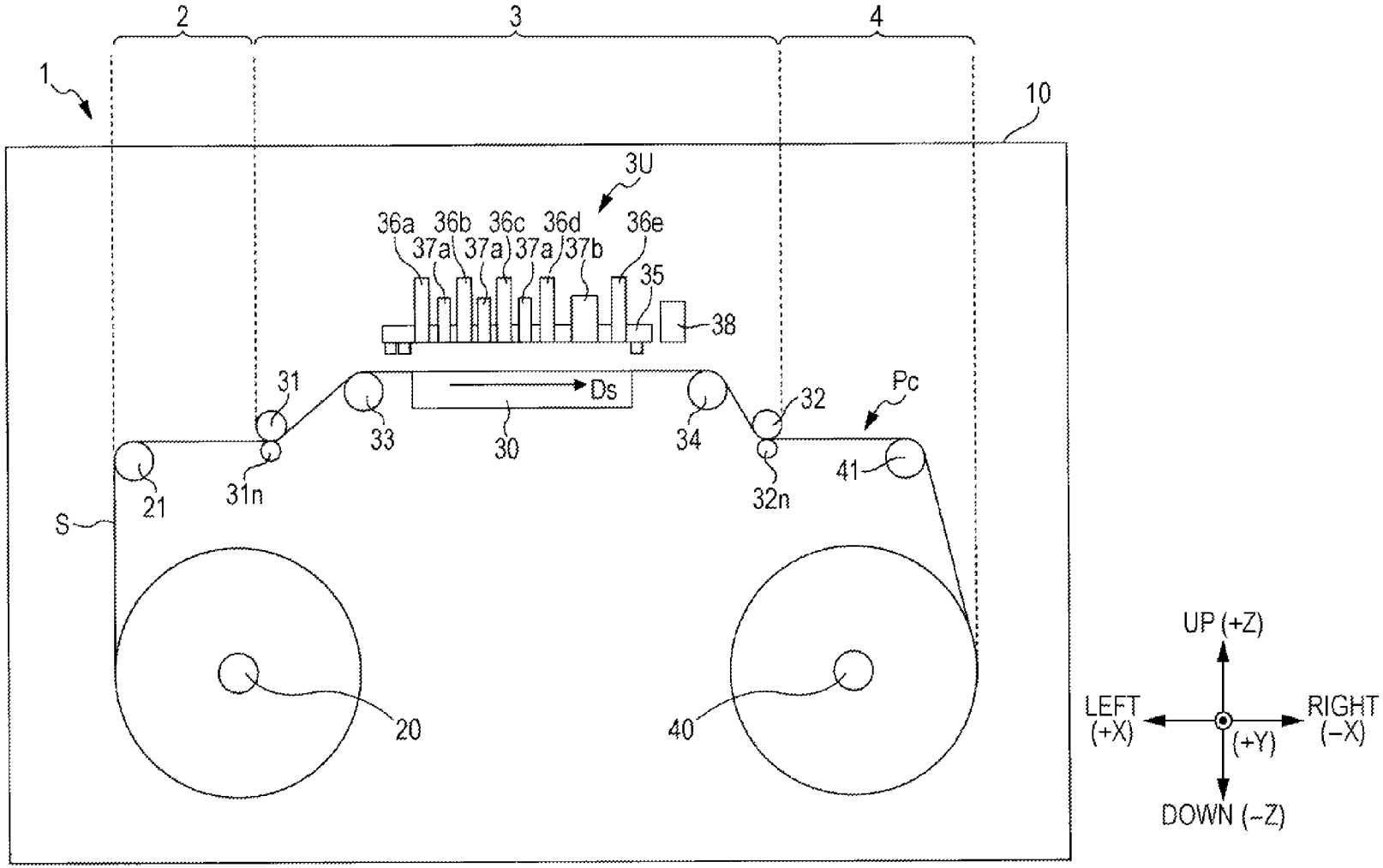
FIG. 1 is a front view which schematically illustrates a first embodiment of a printing apparatus according to the invention.

FIG. 1 is a front view which schematically illustrates a first embodiment of a printing apparatus according to the invention. To clearly illustrate a positional relationship between parts of the apparatus, a three-dimensional coordinate system in which a right-left direction X, a front-rear direction Y, and a vertical direction Z of a printing apparatus 1 are established is applied to FIG. 1 and the following drawings, if it is necessary.

A feeding portion 2, a processing portion 3 and a winding portion 4 are aligned, in the right-left direction, in the printing apparatus 1, as illustrated in FIG. 1. These functional portions 2, 3, and 4 are accommodated in an exterior member 10. The feeding portion 2 has a feeding shaft 20 and the winding portion 4 has a winding shaft 40. Both ends of a paper sheet S (a web) are wound, in a roll shape, around the feeding portion 2 and the winding portion 4, and a transporting path Pc is extended between both ends. The paper sheet S is transported, along the transporting path Pc extended as described above, from the feeding shaft 20 to the processing portion 3. The transported paper sheet S is subjected to an image recording process by a head unit 3U, and then the paper sheet S is transported to the winding shaft 40. Types of the paper sheet S which correspond to a "recording medium" of the invention are divided broadly into a paper-based medium and a film-based medium. Specific examples of the paper-based medium include a wood free paper, a cast paper, an art paper, and a coated paper. Specific examples of the film-based medium include a synthetic paper, Polyethylene terephthalate (PET), and polypropylene (PP). In the following description, a surface out of both surfaces of the paper sheet S, which is subjected to image recording, is referred to as a front surface. A surface opposing the front surface is referred to as a back surface.

The feeding portion 2 includes the feeding shaft 20 around which the end of the paper sheet S is wound and a driven roller 21 around which the paper sheet S fed from the feeding shaft 20 is wound. The paper sheet S is supported by the feeding shaft 20 in a state where the front surface of the paper sheet S faces outside and the end of the paper sheet S is wound around the feeding shaft 20. When the feeding shaft 20 rotates in a clockwise direction in a plane of FIG. 1, the paper sheet S which is wound around the feeding shaft 20 passes through the driven roller 21 and is fed to the processing portion 3.

In the processing portion 3, the paper sheet S which is fed from the feeding portion 2 is supported by a flat-type platen 30 (corresponding to a "supporting member" of the invention) having a planar shape. Furthermore, in the processing portion 3, image recording is performed on the paper sheet S in such a manner that the paper sheet S is subjected to appropriate processing by the head unit 3U which is disposed along a surface of the platen 30. In the processing portion 3, a front driving roller 31 and a rear driving roller 32 are provided on both sides of the platen 30. Furthermore, in the processing portion 3, the paper sheet S which is transported from the front driving roller 31 to the rear driving roller 32 is subjected to image printing in a state where the paper sheet S is supported by the platen 30.

A plurality of fine projections which is formed by a thermal spraying method is formed on an outer circumference surface of the front driving roller 31. The front surface side of the paper sheet S which is fed from the feeding portion 2 is wound around the front driving roller 31. When the front driving roller 31 rotates in a counterclockwise direction in the plane of FIG. 1, the paper sheet S which is fed from the feeding portion 2 is transported in a downstream side of the transporting path Pc. A nip roller 31*n* is provided so as to correspond to the front driving roller 31. The nip roller 31*n* abuts on the back surface of the paper sheet S in a state where the nip roller 31*n* is biased to the front driving roller 31 side. The paper sheet S is pinched between the nip roller 31*n* and the front driving roller 31. Accordingly, a friction force is ensured between the front driving roller 31 and the paper sheet S, and thus the front driving roller 31 can reliably transport the paper sheet S.

The flat-type platen 30 is supported by a supporting mechanism (not illustrated) such that the surface (an upper surface) of the platen 30, which supports the paper sheet S, is horizontal. Driven rollers 33 and 34 are provided on right and left sides of the platen 30. The paper sheet S is transported from the front driving roller 31 to the rear driving roller 32 and the back surface side of the paper sheet S is wound around the driven rollers 33 and 34. Top ends of the driven rollers 33 and 34 are disposed to be located at the same position of the surface of the platen 30 or located slightly lower than the surface thereof. The driven rollers 33 and 34 are configured such that the paper sheet S which is transported from the front driving roller 31 to the rear driving roller 32 can maintain a state where the paper sheet S abuts on the platen 30.

A plurality of fine projections which is formed by a thermal spraying method is formed on an outer circumference surface of the rear driving roller 32. The front surface side of the paper sheet S which is transported from the platen 30 and passes through the driven roller 34 is wound around the rear driving roller 32. When the rear driving roller 32 rotates in the counterclockwise direction in the plane of FIG. 1, the paper sheet S is transported to the winding portion 4. A nip roller 32*n* is provided so as to correspond to the rear driving roller 32. The nip roller 32*n* abuts on the back surface of the paper sheet S in a state where the nip roller 32*n* is biased to the rear driving roller 32 side. The paper sheet S is pinched between the nip roller 32*n* and the rear driving roller 32. Accordingly, a friction force is ensured between the rear driving roller 32 and the paper sheet S, and thus the rear driving roller 32 can reliably transport the paper sheet S.

The paper sheet S which is transported from the front driving roller 31 to the rear driving roller 32 is supported by the platen 30 and transported, above the platen 30, in a transporting direction Ds. The head unit 3U is provided in the processing portion 3 to perform color-printing on the surface of the paper sheet S which is supported by the platen 30. Specifically, the head unit 3U includes four heads 36*a* to 36*d* which are aligned, along the transporting direction Ds, from an upstream side to a downstream side. The heads 36*a* to 36*d* correspond to yellow, cyan, magenta, and black. Each of the heads 36*a* to 36*d* faces, with a slight clearance, the surface of the paper sheet S supported by the platen 30. Each of the heads 36*a* to 36*d* discharges ink having a corresponding color, in an ink jet manner. The respective heads 36*a* to 36*d* discharge the ink on the paper sheet S which is transported in the transporting direction Ds, and thus a color image is formed on the surface of the paper sheet S.

Incidentally, ultraviolet (UV) ink (photo-curable ink) which is cured by receiving an ultraviolet ray (light beam) is used as the ink. In this case, the head unit 3U includes UV lamps 37*a* and 37*b* to cure and fix the ink on the paper sheet S. This ink curing is performed in two steps, that is, temporary curing and normal curing. The UV lamp 37*a* for performing the temporary curing is disposed between adjacent heads (the respective heads 36*a* to 36*d*). In other words, the UV lamp 37*a* emits ultraviolet rays of which an accumulated amount of light is small such that the ink is cured (temporarily cured) to the extent where the shape of the ink does not collapse. The UV lamp 37*a* does not completely cure the ink. Meanwhile, the UV lamp 37*b* for performing normal curing is provided on the downstream side of the heads 36*a* to 36*d* in the transporting direction Ds. In other words, the UV lamp 37*b* emits ultraviolet rays of which an accumulated amount of light is greater than that of the UV lamp 37*a* such that the ink is completely cured (normally cured). The temporary curing and the normal curing are performed as described above, and the color image which is formed by the heads 36*a* to 36*d* can be fixed on the surface of the paper sheet S.

Furthermore, the head unit 3U has a head 36*e*. The head 36*e* is positioned on the downstream side of the UV lamp 37*b* in the transporting direction Ds. The head 36*e* faces, with a slight clearance, the surface of the paper sheet S which is supported by the platen 30. The head 36*e* discharges, in an ink jet manner, transparent UV ink on the surface of the paper sheet S. In other words, the transparent ink is additionally discharged on the color image which is formed by the heads 36*a* to 36*d* corresponding to four colors. Furthermore, an UV lamp 38 is provided, in addition to the head unit 3U, on the downstream side of the head 36*e* in the transporting direction Ds. The UV lamp 38 emits intense ultraviolet rays such that the transparent ink discharged by the head 36*e* is completely cured (normally cured). As a result, the transparent ink can be fixed on the surface of the paper sheet S.

In the processing portion 3, the ink discharging and the ink curing are appropriately performed on the paper sheet S which is supported by the platen 30, as described above. Therefore, the color image which is coated with the transparent ink is formed. Subsequently, the paper sheet S on which the color image is formed is transported, by the rear driving roller 32, to the winding portion 4.

The winding portion 4 has the winding shaft 40 around which the end of the paper sheet S is wound and a driven roller 41 around which the paper sheet S transported to the winding shaft 40 is wound. The paper sheet S is supported by the winding shaft 40 in a state where the front surface of the paper sheet S faces outside and the end of the paper sheet S is wound around the winding shaft 40. When the winding shaft 40 rotates in a clockwise direction in a plane of FIG. 1, the paper sheet S passes through the driven roller 41 and is wound around the winding shaft 40.

In this case, only one frame member 35 is illustrated in FIG. 1, and the head unit 3U has a pair of the frame members 35 extending in the transporting direction Ds. These frame members 35 are spaced apart, in the front-rear direction Y, from each other by a constant distance. A plurality of carriages is mounted on the pair of the frame members 35 and 35 so as to be movable in an up-down direction Z, as described below. The heads 36*a* to 36*e* and the UV lamps 37*a* and 37*b* are detachably mounted on the carriage. Furthermore, in a state where the carriage is mounted on and supported by the frame member 35, the heads 36*a* to 36*e* and the UV lamps 37*a* and 37*b* which are held in the carriage can integrally move with the frame member 35. In other words, when the frame members 35 move, the heads 36*a* to 36*e* and the UV lamps 37*a* and 37*b* move along with the frame members 35. It is possible to move all of the heads 36*a* to 36*e* at the same time by moving the frame members 35, as described above. Accordingly, it is easy to switch states (a printing state, a maintenance state, and a manual work state) described below. In each state, when the carriage moves, the heads 36*a* to 36*e* move, with respect to the frame members 35, in the ink discharging direction Z and are positioned. Details of a configuration and an operation of this will be described below.

Figure 2:
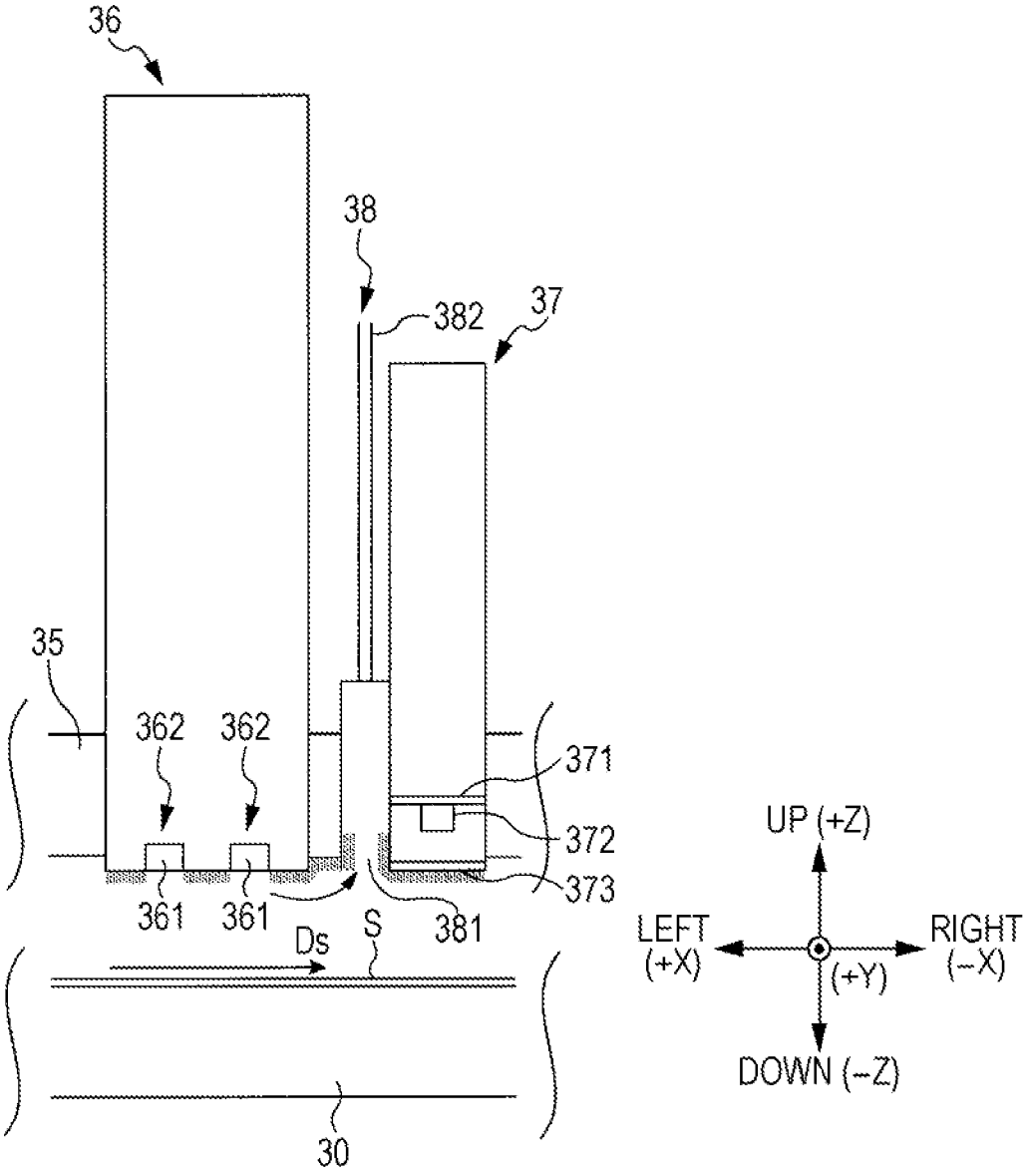
FIG. 2 is an enlarged front view illustrating details of the vicinity of a head.

Next, configurations in the vicinity of nozzles of the head will be described with reference to FIG. 2. FIG. 2 is an enlarged front view illustrating details of the vicinity of the head. In this case, the heads 36*a* to 36*e* basically have the same configuration, except that the colors of the ink and the types of the ink are different from each other. Also, the UV lamps 37*a* and 37*b* which are disposed between adjacent heads (the heads 36*a* to 36*e*) are basically have the same configuration. In FIG. 2 and the following description, the heads 36*a* to 36*e* are referred to as the head 36 if the heads 36*a* to 36*e* are not particularly distinguished from each other. Further, the UV lamps 37*a* and 37*b* are referred to as the UV lamp 37 if the UV lamps 37*a* and 37*b* are not particularly distinguished from each other.

A plurality of nozzles 361 is formed on a surface (a nozzle forming surface) of the head 36, which faces the platen 30. Various types of arrangements can be appropriately applied to the nozzles 361. In this case, the plurality of the nozzles 361 are aligned in the front-rear direction (the Y direction) to form a nozzle row 362, and two nozzle rows 362 are provided in the transporting direction Ds. The ink is discharged, at the proper time, from each nozzle 361 to the paper sheet S which is supported by the platen 30, and thus an image is printed on the paper sheet S.

In addition, the UV lamp 37 has a light emitting portion 372 provided on a substrate 371. A plurality of the light emitting portions 372 are aligned in the front-rear direction and form a row of which a length is substantially the same as a length of the nozzle row 362. The light emitting portions 372 can irradiate a part of the paper sheet S in a width direction, on which the image is formed. A surface of the UV lamp 37, which faces the platen 30, is constituted by a glass plate 373. When light emitting portion 372 emits a light beam, the emitted light beam passes through the glass plate 373 and is applied to the surface of the paper sheet S which is supported by the platen 30. As a result, the ink which is discharged, by the head 36, on the surface of the paper sheet S is cured.

Furthermore, in the transporting direction Ds, a mist suctioning portion 38 which is integrally formed with the UV lamp 37 is provided between the head 36 and the UV lamp 37 in a state where the mist suctioning portion 38 is supported by the frame members 35. A suction port 381 of the mist suctioning portion 38 extends in the front-rear direction such that a length of the suction port 381 is approximately the same as the length of the nozzle row 362. An opening surface (a lower surface) of the suction port 381 is located, in terms of the up-down direction, at the same position or at the position slightly higher than that of the nozzle forming surface of the head 36. The suction port 381 and a negative pressure generation portion (not shown) are connected through a suction hose 382. When the negative pressure generation portion is operated, negative pressure is generated in the suction port 381, and thus an ink mist which is scattered in a mist state is sucked up to the suction port 381. As a result, the scattered ink mist is prevented from adhering to the paper sheet S or from being scattered over an inside of the apparatus so as to contaminate components.

In this case, the ink is likely to adhere to, for example, the nozzle forming surface and a side surface of the head 36, a lower surface of the frame members 35, a lower surface of the glass plate 373 of the UV lamp 37, and an inner wall surface of the suction port 381 of the mist suctioning portion 38 (portions illustrated in FIG. 2 with a dot pattern). There is a possibility that the ink may be dropped or is scattered, and thus the paper sheet S is contaminated by the ink. In addition, there is a possibility that, when the printing apparatus is repeatedly used, ink clogging may be caused in the nozzles 361, and thus ink discharging may be hindered. To prevent the problems described above, some kinds of ink jet type printing apparatuses are equipped with a maintenance unit.

As such a maintenance unit, a maintenance unit disclosed in, for example, JP-A-2012-086409 has been known. Thus, the detailed description of the maintenance unit will not be repeated. An overview of a maintenance (a first maintenance) which is performed by a maintenance unit will be described simply. Examples of processes which are performed by the maintenance unit include, for example, capping, cleaning, and wiping. Capping is a process in which the nozzles are covered with a cap, and thus the ink in the nozzles is prevented from increasing in viscosity. Cleaning is a process in which the nozzles are covered with the cap and a negative pressure is generated in the cap, and thus the ink in the nozzles is forcedly discharged. This cleaning allows the ink having an increased viscosity and air bubbles in the ink to be removed from the nozzles. In addition, wiping is a process in which the nozzle forming surface of the head is wiped with a wiper. This wiping allows the ink to be wiped off from the nozzle forming surface of the head.

As described above, the maintenance unit can wipe out the ink adhering to the nozzle forming surface of the head 36 or prevent the ink clogging in the nozzles 361 from occurring. However, in some cases, the ink adhering to, for example, the side surface of the head 36, the lower surface of the frame members 35, the lower surface of the glass plate 373 of the UV lamp 37, or the inner wall surface of the suction port 381 of the mist suctioning portion 38 cannot sufficiently be removed in the processes performed by the maintenance unit. In this case, it is necessary for an operator to clean each part of the head unit 3U by hand, after the maintenance performed by the maintenance unit.

In such a situation, the printing apparatus 1 according to the first embodiment is configured such that the printing apparatus 1 can be in a printing state in which the head 36 faces the platen 30 and performs image printing, a maintenance state in which the head 36 faces the maintenance unit and is subjected to maintenance, or a manual work state in which a manual work (a second maintenance) is performed on the head 36. Furthermore, to effectively perform the maintenance or the manual work, the printing apparatus 1 is configured such that the maintenance state and other states can be easily switched without greatly moving the maintenance unit.

Figure 3:
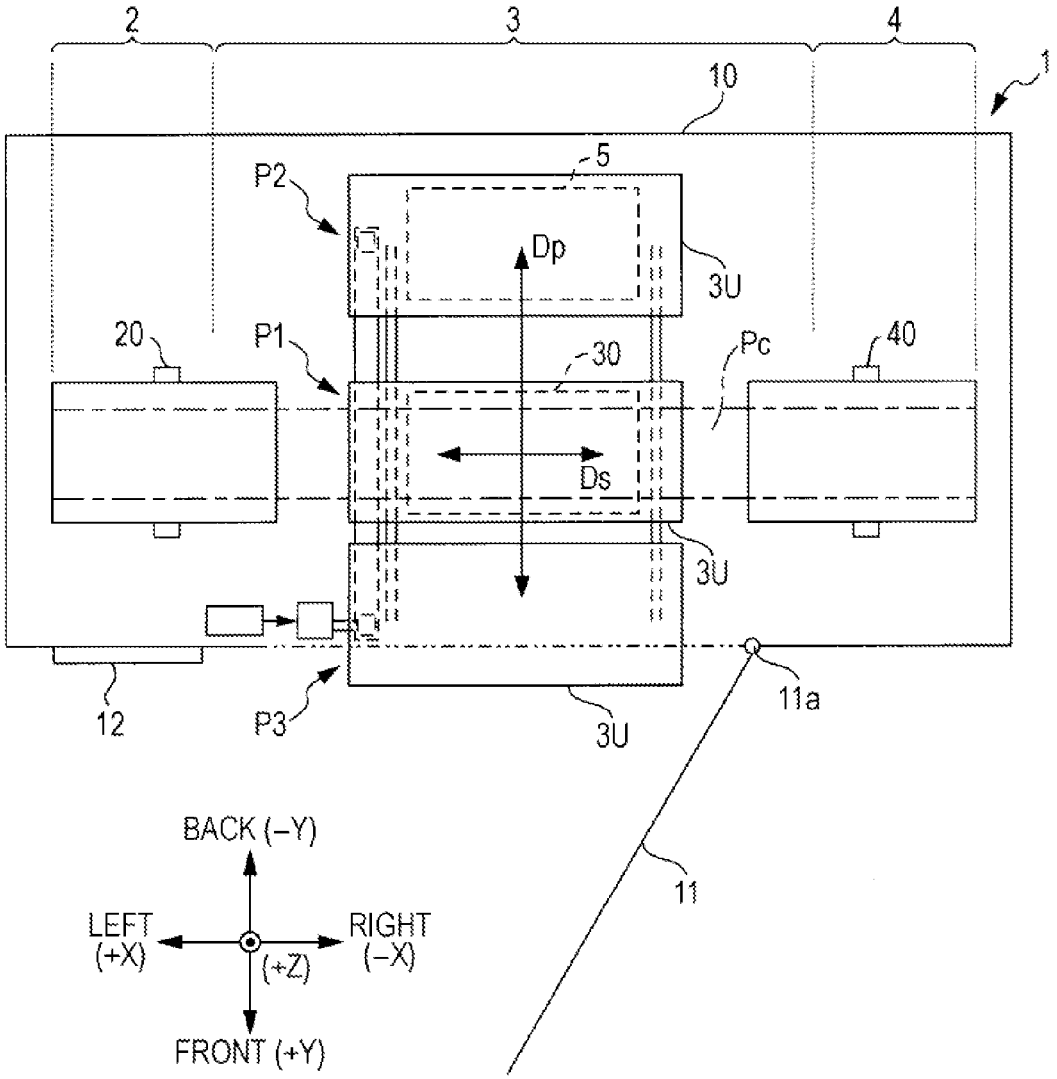
FIG. 3 is a plan view illustrating a movement aspect of a head unit according to the first embodiment.
Figure 4:
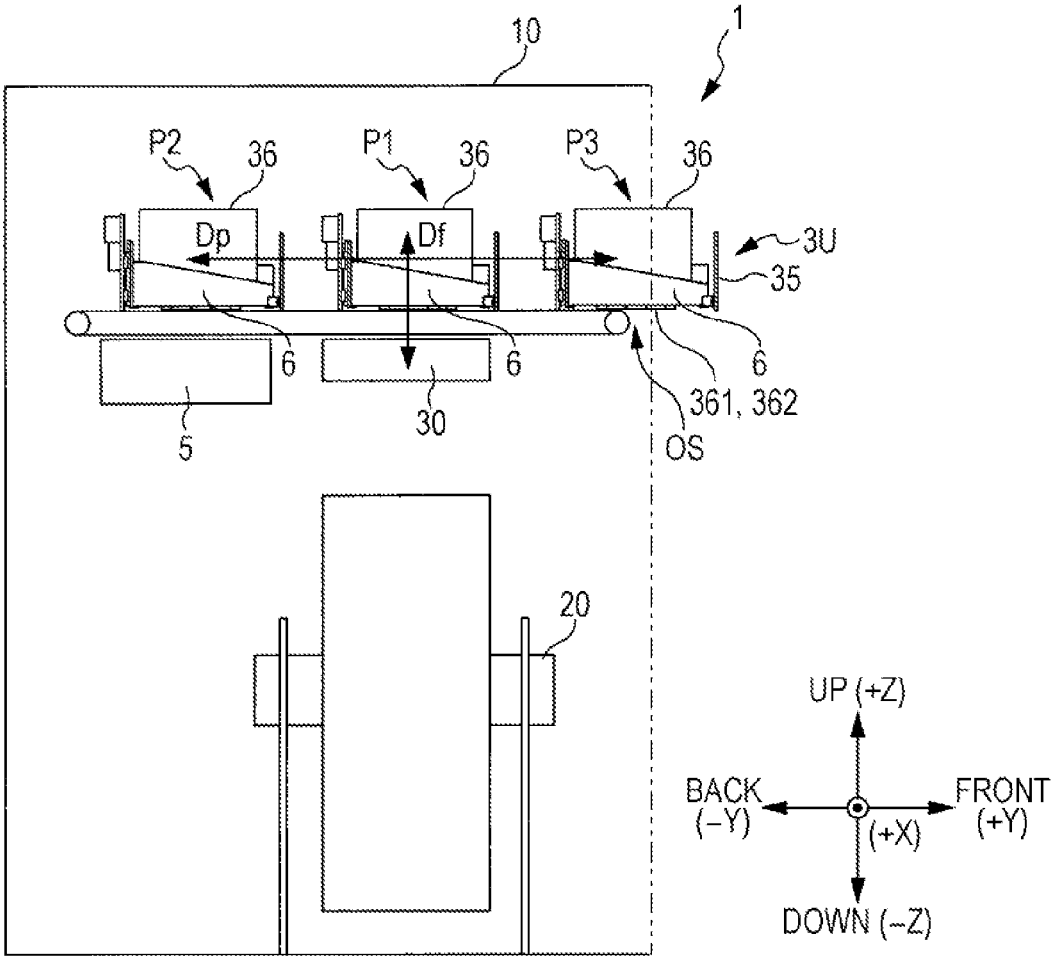
FIG. 4 is a side view illustrating a movement aspect of the head unit according to the first embodiment.

FIG. 3 is a plan view illustrating a movement aspect of the head unit according to the first embodiment, and FIG. 4 is a side view illustrating a movement aspect of the head unit according to the first embodiment. For reasons of easy understanding of the description, FIGS. 3 and 4 chiefly illustrate a positional relationship between the head unit 3U, the platen 30, and a maintenance unit 5. Furthermore, illustrations of other members are properly omitted in the FIGS. 3 and 4. Furthermore, states of the head unit 3U, in which the head unit 3U moves between three positions, are illustrated in FIGS. 3 and 4, and it is not intended to mean that three head units 3U are provided. In the first embodiment, the maintenance unit 5 is disposed behind the platen 30 which is disposed in the vicinity of a central portion of the printing apparatus 1, as illustrated in FIGS. 3 and 4. Furthermore, a guiding mechanism (not illustrated) is provided such that the head unit 3U can move in a perpendicular direction Dp (the front-rear direction) which is perpendicular, in a plan view, to the transporting direction Ds (the right-left direction) of the paper sheet S, and thus the head unit 3U can be positioned at a first position P1, a second position P2, or a third position P3.

In this case, the first position P1 is a position where the head unit 3U faces the platen 30. When the head unit 3U is positioned at the first position P1, the printing apparatus 1 is in the printing state where the head 36 faces the platen 30 and the head 36 performs image recording on the paper sheet S which is located on the platen 30. Each head 36 is configured such that the head 36 can move albeit only slightly in a direction, that is, the discharging direction Z, in which the head 36 moves close to or away from the platen 30. This configuration allows the head unit 3U to move in a state (a separated state) where a gap between the head unit 3U and the platen 30 is greater than a gap in a state (an approached state) where the head unit 3U comes close to the platen 30 and performs image recording. Thus, it is possible to prevent the head unit 3U from coming into contact with the platen 30. The details of a configuration for moving the head 36 in the up-down direction Z will be described below.

The second position P2 is a position at which the head unit 3U faces the maintenance unit 5. When the head unit 3U is positioned at the second position P2, the printing apparatus 1 is in the maintenance state where the head 36 faces the maintenance unit 5 and the maintenance unit 5 performs maintenance of the head 36. In addition, the third position P3 is positioned further forward than the first position P1. When the head unit 3U is positioned at the third position P3, the entirety of the head 36 protrudes from the platen 30 and the maintenance unit 5, in terms of the perpendicular direction Dp, particularly, in a direction from the maintenance unit 5 toward the platen 30. In other words, when the head 36 is positioned at the third position P3, a rear end of the nozzle forming surface of the head 36 is located further forward than a front end of the platen 30. Furthermore, the entirety of the head 36 does not face, in terms of the perpendicular direction Dp, either the platen 30 or the maintenance unit 5, and thus a wide open space OS (see FIG. 4) is secured under the entirety of the head 36 in the perpendicular direction Dp. Therefore, the printing apparatus 1 is in the manual work state where an operator can access to the head 36 and perform a manual work on the head 36 through the open space OS. In the manual work state, not only the cleaning of each part of the head unit 3U is performed by hand mentioned above, but replacement work of the head 36 or the light emitting portion 372 of the UV lamp 37 can also be performed. Even when the maintenance work is performed as described above, a configuration described below allows the head 36 to move in the up-down direction Z.

Figure 5:
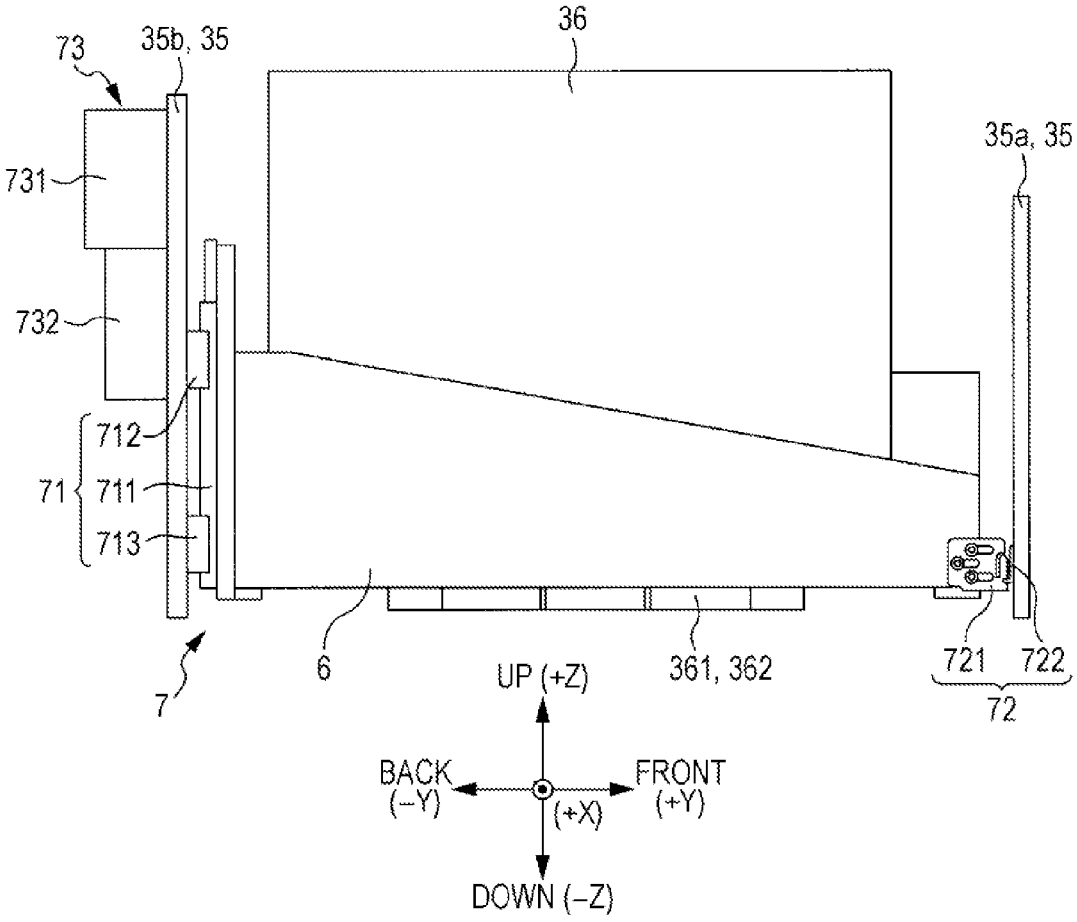
FIG. 5 is a view illustrating a carriage and a carriage moving mechanism.
Figure 6:
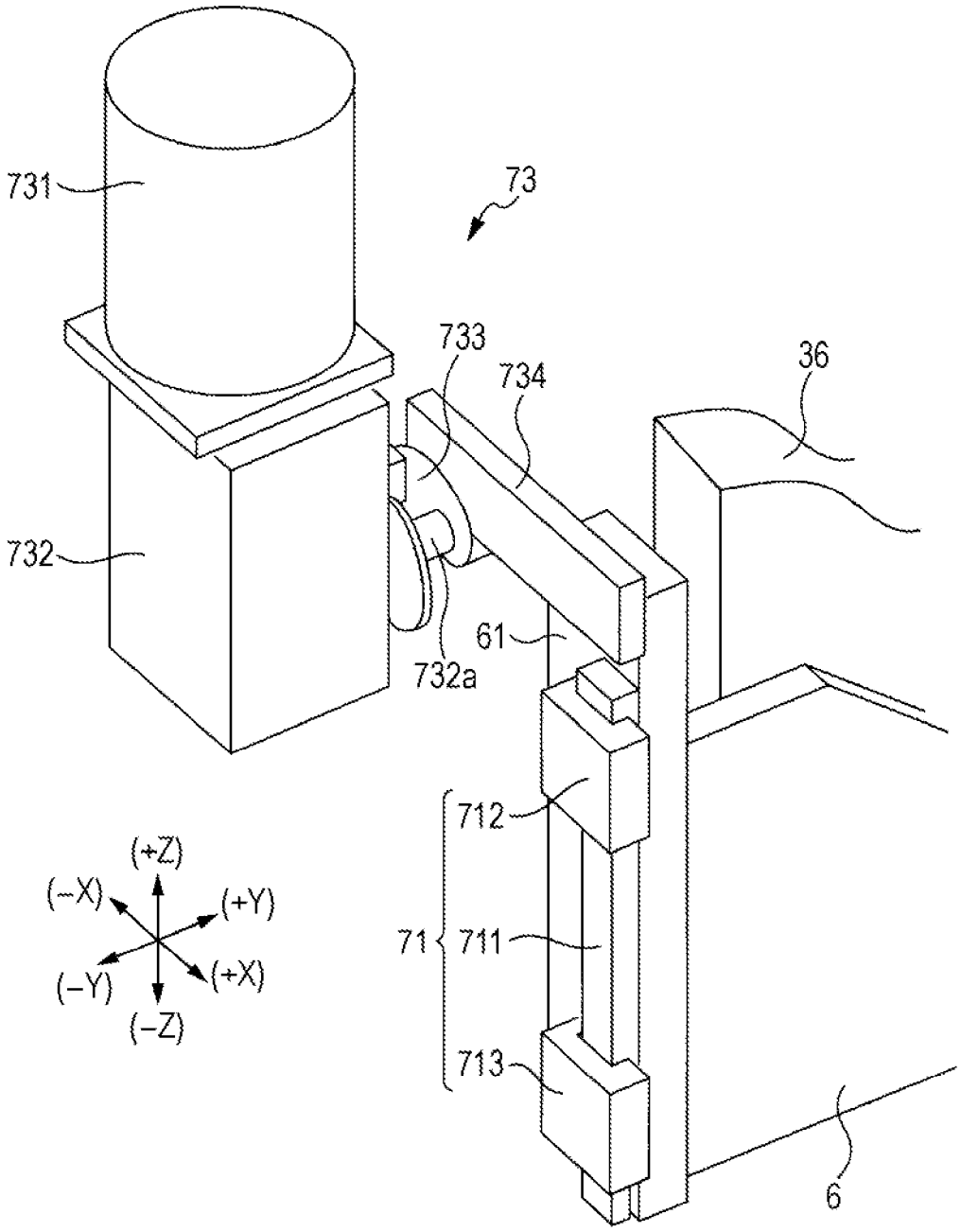
FIG. 6 is a perspective view illustrating a first guiding mechanism and a driving mechanism of the carriage moving mechanism.
Figure 7A:
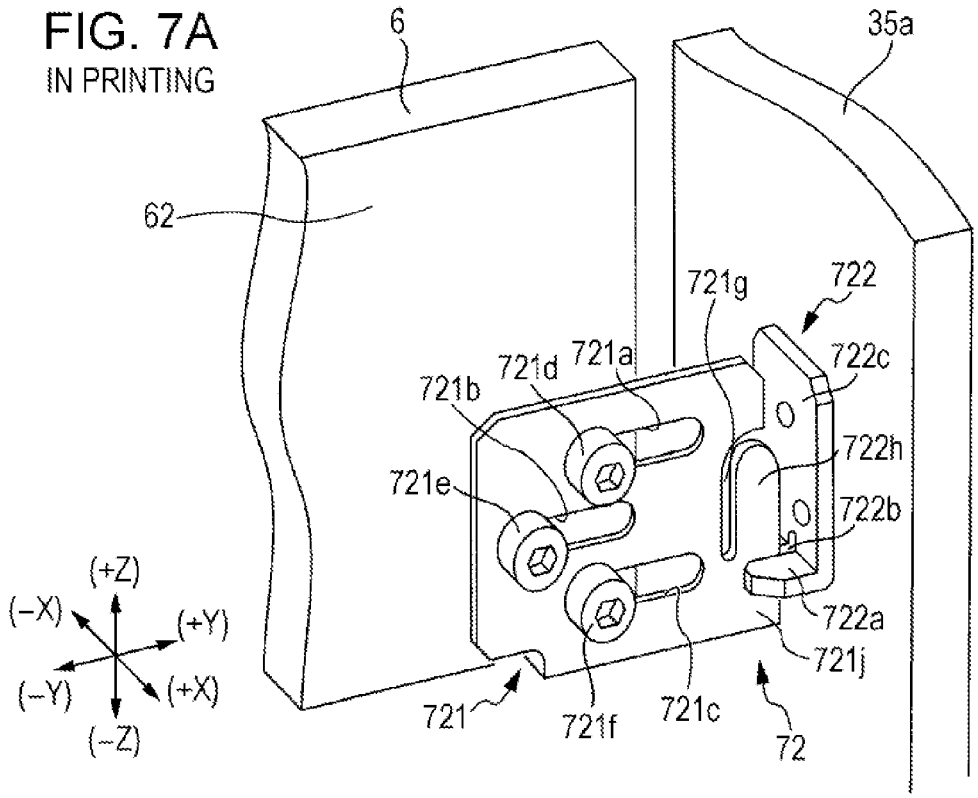
FIGS. 7A and 7B are perspective views illustrating a second guiding mechanism of the carriage moving mechanism.
Figure 7B:
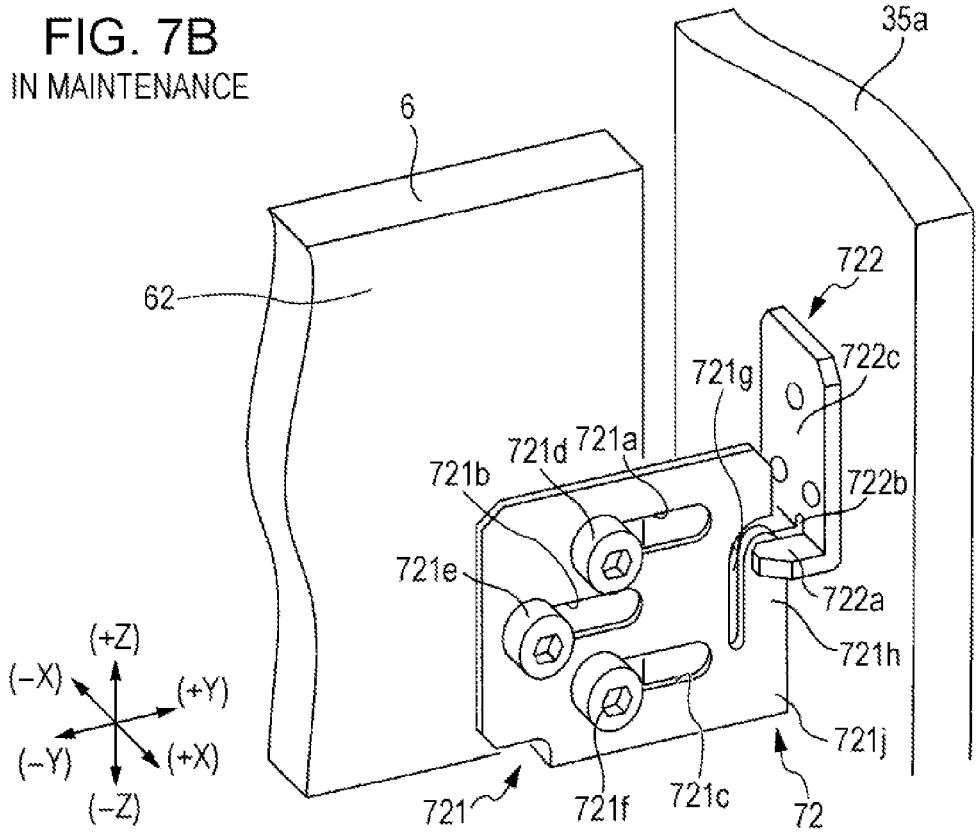

Next, a configuration for moving and positioning each head 36 in the ink discharging direction will be described with reference to FIGS. 5 to 7B. FIG. 5 is a view illustrating a carriage to hold the head and a carriage moving mechanism for moving the carriage. FIG. 6 is a perspective view illustrating a first guiding mechanism and a driving mechanism of the carriage moving mechanism. In addition, FIGS. 7A and 7B are perspective views illustrating a second guiding mechanism of the carriage moving mechanism. In this case, the frame member 35 of the pair of frame members 35 and 35, which is located on a front side (+Y), is referred to as a "front frame member 35*a*", and the other frame member 35 located on a rear side (−Y) is referred to as a "rear frame member 35*b*". The rear frame member 35*b* is not illustrated in FIG. 6.

A carriage 6 is disposed between the front frame member 35*a* and the rear frame member 35*b*. The carriage 6 can detachably hold the head 36. In addition, a carriage moving mechanism 7 described below allows the carriage 6 to move, with respect to both frame members 35*a* and 35*b*, in the ink discharging direction Z. Thus, in a state where the head 36 is held in the carriage 6, the carriage moving mechanism 7 causes the carriage 6 to move in the discharging direction Z and be positioned at the printing position. Therefore, the head 36 can be positioned at a position suitable for printing and perform a proper printing operation. In addition, when maintenance work is performed, the carriage moving mechanism 7 causes the carriage 6 to move to and be positioned at a maintenance position (a non-printing position) which is different, in terms of the discharging direction Z, from the printing position described above. Therefore, the head 36 held in the carriage 6 can be positioned at a position suitable for performing maintenance.

The carriage moving mechanism 7 has two types of guiding mechanisms 71 and 72 and a driving mechanism 73 for driving the carriage 6 in the discharging direction Z. In this case, a distance by which the guiding mechanism 71 is able to move relative to a positioning position is different from a distance by which the guiding mechanism 72 is able to move relative to a positioning position. In other words, two types of guiding mechanisms 71 and 72 have different positioning accuracy.

The first guiding mechanism 71 is provided on the rear frame member 35*b* side, that is, a rear side (−Y) of the carriage 6. The first guiding mechanism 71 is a so-called linear guiding mechanism which is constituted by a guide rail 711 extending in the discharging direction Z and two sliders 712 and 713 that slide along the guide rail 711, as illustrated in FIGS. 5 and 6. The guide rail 711 is fixed to a rear side surface 61 of the carriage 6. In addition, (+Y) side end portions of the sliders 712 and 713 are movably engaged with the guide rail 711. (−Y) side end portions of the sliders 712 and 713 are mounted on the rear frame member 35*b* (see FIG. 5). Therefore, the first guiding mechanism 71 can guide the movement of the carriage 6 relative to the rear frame member 35*b*, which is performed in the discharging direction Z, with positioning accuracy higher than the positioning accuracy of the second guiding mechanism 72.

Meanwhile, the second guiding mechanism 72 is provided on the front frame member 35*a* side, that is, a front side (+Y) of the carriage 6. The second guiding mechanism 72 has a movable plate 721 and a fixed plate 722, as illustrated in FIGS. 5, 7A, and 7B. The movable plate 721 is disposed so as to face a front corner lower portion (a lower right portion in FIG. 7A or 7B) of a (+X) side surface 62 of the carriage 6. Long holes 721*a* to 721*c* which extend in the Y direction are provided in a central portion of the movable plate 721. Each of bolts 721*d* to 721*f* are inserted into a respective long hole 721*a* to 721*c* so as to be screwed into female screw holes (not illustrated) which are formed on the front corner lower portion in advance. When the bolts 721*d* to 721*f* are loosened, the movable plate 721 is movable in the Y direction. In this state, positioning of the movable plate 721 can be performed with respect to the carriage 6. Subsequently, in a state where the positioning of the movable plate 721 is completed, when the bolts 721*d* to 721*f* are firmly screwed into the female screw holes, the movable plate 721 is fixed to the (+X) side surface 62 of the carriage 6.

A slit 721*g* extends from a (+Y) side center end surface of the movable plate 721 to a vicinity of the long hole 721*c*. Accordingly, the (+Y) side center end portion of the movable plate 721 functions as a plate spring portion 721*h*. In the (+Y) side center end portion of the movable plate 721, a portion 721*j* which extends from the plate spring portion 721*h* to a lower side maintains rigidity. The portion 721*j* corresponds to a "rigid portion" of the invention. It is preferable that an elastic modulus of the plate spring portion 721*h* be set to a value in which linear elastic of the plate spring portion 721*h* is ensured with respect to a load, that is, a static allowable moment, of the first guide member.

The fixed plate 722 is formed in a substantially L shape in which a lower end portion of a metal plate extending in the up-down direction Z is bent, in the (−Y) direction, by about 90°. A slit portion 722*b* of which a width is slightly greater than a thickness of the movable plate 721 is formed on a bent tip portion 722*a*. A plate spring portion 721*h* and the rigid portion 721*j* of the movable plate 721 are fittable to the slit portion 722*b*. A rear end portion 722*c* of the fixed plate 722 is fixed to a (−Y) side surface of the front frame member 35*a* by a bolt (not illustrated).

The plate spring portion 721*h* or the rigid portion 721*j* is fitted to the slit portion 722*b* of the fixed plate 722. The movable plate 721 moves in the up-down direction Z while the fitted state described above is maintained, and thus the movable plate 721 guides the movement of the carriage 6 relative to the front frame member 35*a*, which is performed in the discharging direction Z.

In the first embodiment, the second guiding mechanism 72 guides the movement of a front side of the carriage 6 in the Z direction and the first guiding mechanism 71 guides the movement of a rear side of the carriage 6 in the Z direction, as described above. Accordingly, the carriage 6 holding the head 36 is movable in the ink discharging direction Z. In addition, the driving mechanism 73 is provided in the carriage moving mechanism 7 to move the carriage 6.

Referring back to FIG. 6, a configuration of the driving mechanism 73 will be described. The driving mechanism 73 has a driving motor 731, a power transmission portion 732, a cam 733, and a connection plate 734. A rotating shaft of the driving motor 731 is connected to the power transmission portion 732. When the driving motor 731 is operated in response to a drive command from the controller (not illustrated) which controls the entirety of the apparatus, a rotational movement of the rotating shaft passes through a worm gear mechanism which is provided in the power transmission portion 732 and is transmitted to an output shaft 732*a* of the power transmission portion 732. Therefore, the output shaft 732*a* extending in the (+Y) direction rotates. The cam 733 is fixed to the tip of the output shaft 732*a* and eccentrically rotates corresponding to an operation of the driving motor 731.

The connection plate 734 is arranged in a substantially horizontal posture such that the connection plate 734 connects the cam 733 and the carriage 6. A (−X) side end portion of the connection plate 734 abuts on an outer circumferential surface of the cam 733 and a (+X) side end portion thereof is fixed to the rear side surface 61 of the carriage 6. Although not illustrated in the accompanying drawings, the connection plate 734 is biased downward (−Z) and movable in the up-down direction Z by the guiding mechanism. Thus, the connection plate 734 moves, in response to an eccentric rotation of the cam 733, in the up-down direction Z in a state where the connection plate 734 maintains a substantially horizontal posture. Accordingly, the carriage 6 is moved corresponding to this operation. In this case, the carriage 6 is moved in the up-down direction Z by using a cam mechanism. However, without being limited thereto, other types of driving mechanisms, such as a driving mechanism using a ball screw and a driving mechanism using an actuator, for example, a cylinder, can be applied.

The carriage moving mechanism 7 configured as above can be assembled by following a procedure described below. First, the fixed plate 722 is temporarily fixed to the frame member 35*a* in advance, and then the movable plate 721 is slid to the first guiding mechanism 71 side, and then the movable plate 721 is temporarily fixed in a state where the movable plate 721 moves backward, in the (−Y) direction, from the (+Y) side end surface of the carriage 6. Next, the sliders 712 and 713 of the first guiding mechanism 71 which is mounted on the carriage 6 are positioned at and fixed to the frame member 35*b*. Accordingly, the mounting of the first guiding mechanism 71 is finished.

Subsequently, in a state where mounting of the first guiding mechanism 71 is finished, the movable plate 721 is slid to the (+Y) direction side and fitted to the slit portion 722*b* of the fixed plate 722 so as to finish assembling of the second guiding mechanism 72. In the state described above, the fixed plate 722 is firmly fixed to the frame member 35*a* in a state where the carriage 6 is positioned around the printing position (see FIG. 7A). Therefore, mounting of the second guiding mechanism 72 is completed, and thus the carriage 6 is movable in the up-down direction Z in a state where the carriage 6 is guided by two guiding mechanisms 71 and 72.

According to the printing apparatus 1 configured as above, positioning accuracy of the carriage 6 by the first guiding mechanism 71 is higher than positioning accuracy thereof by the second guiding mechanism 72, as described above. Thus, the carriage 6 is positioned, with a high level of accuracy, at the printing position (FIG. 7A) or a non-printing position (FIG. 7B). As a result, the head 36 which is held in the carriage 6 can be positioned at the desired position.

When the printing operation is performed, the rigid portion 721*j* of the movable plate 721 is fitted to the slit portion 722*b* of the fixed plate 722, as illustrated in FIG. 7A. Therefore, positional deviation of the carriage 6 is prevented from occurring during the printing operation, and thus it is possible to perform printing processes in a state where the head 36 is stationary. As a result, it is possible to perform printing with a high level of accuracy.

Meanwhile, when the carriage 6 is positioned at a non-printing position so as to receive maintenance, a portion which is fitted to the slit portion 722*b* of the fixed plate 722 is switched from the rigid portion 721*j* to the plate spring portion 721*h*, as illustrated in FIG. 7B. Thus, even when surface accuracy or positional accuracy of the carriage 6 does not satisfy the accuracy required for the use of the first guiding mechanism 71, the accuracy difference can be absorbed by a spring-like property of the plate spring portion 721*h*. Therefore, the accuracy required for assembling or the component accuracy can be reduced, and thus the apparatus can be prevented from increasing in cost. Furthermore, even when an external force is applied to the head 36 or the carriage 6, the external force is absorbed by a biasing force of the plate spring portion 721*h*. Thus, the head 36 or the carriage 6 can be prevented from being greatly deviated from an initial position thereof. As a result, it is possible to effectively prevent a failure or damage of the apparatus from occurring.

Furthermore, the first embodiment achieves an operation effect that assembling of the carriage moving mechanism 7 is easy. In other words, in the case of an apparatus in the related art, such as an apparatus disclosed in JP-A-2009-274285, high-accuracy guiding mechanisms having the same configurations are respectively mounted on both end portions of the carriage 6. Thus, complicated work is required for assembling. However, in the case of the first embodiment, the carriage moving mechanism 7 can be assembled by following the procedure described above. Thus, assembling work is simpler than that of the related art.

In the first embodiment, the movable plate 721 corresponds to an example of a "third guide member" of the invention, and the plate spring portion 721*h* and the rigid portion 721*j* of the movable plate 721 respectively function as a "spring portion" and a "rigid portion" of the invention. Furthermore, the fixed plate 722 corresponds to an example of a "fourth guide member" of the invention.

Figure 8A:
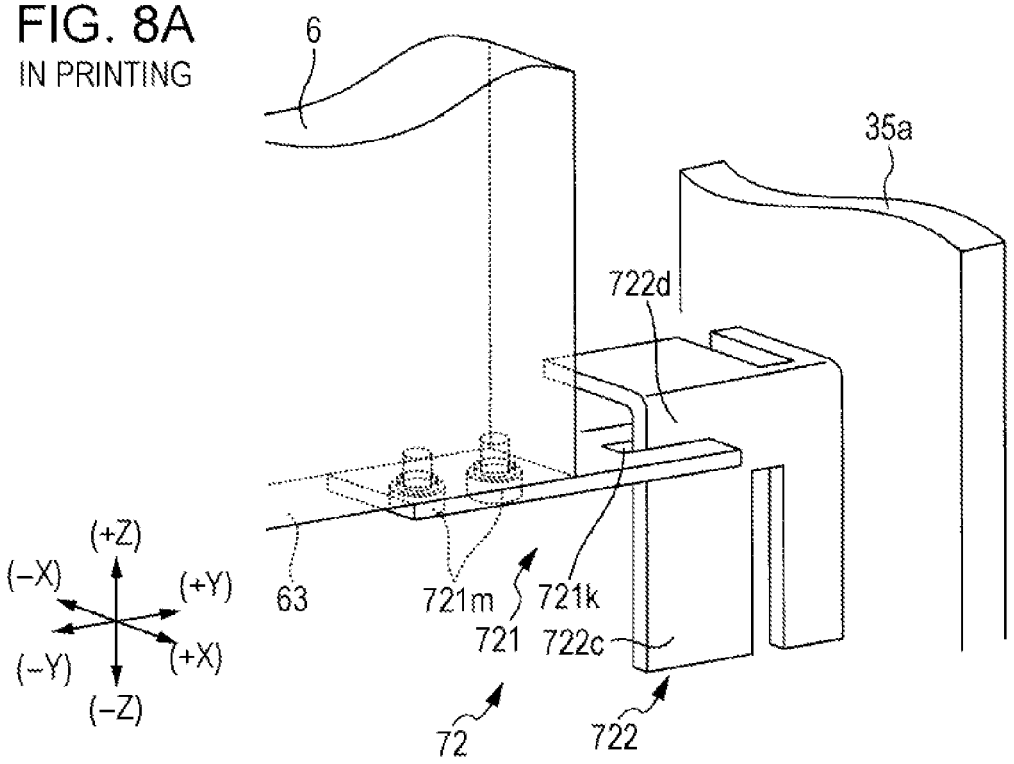
FIGS. 8A and 8B are partial perspective views illustrating a second embodiment of the printing apparatus according to the invention.
Figure 8B:
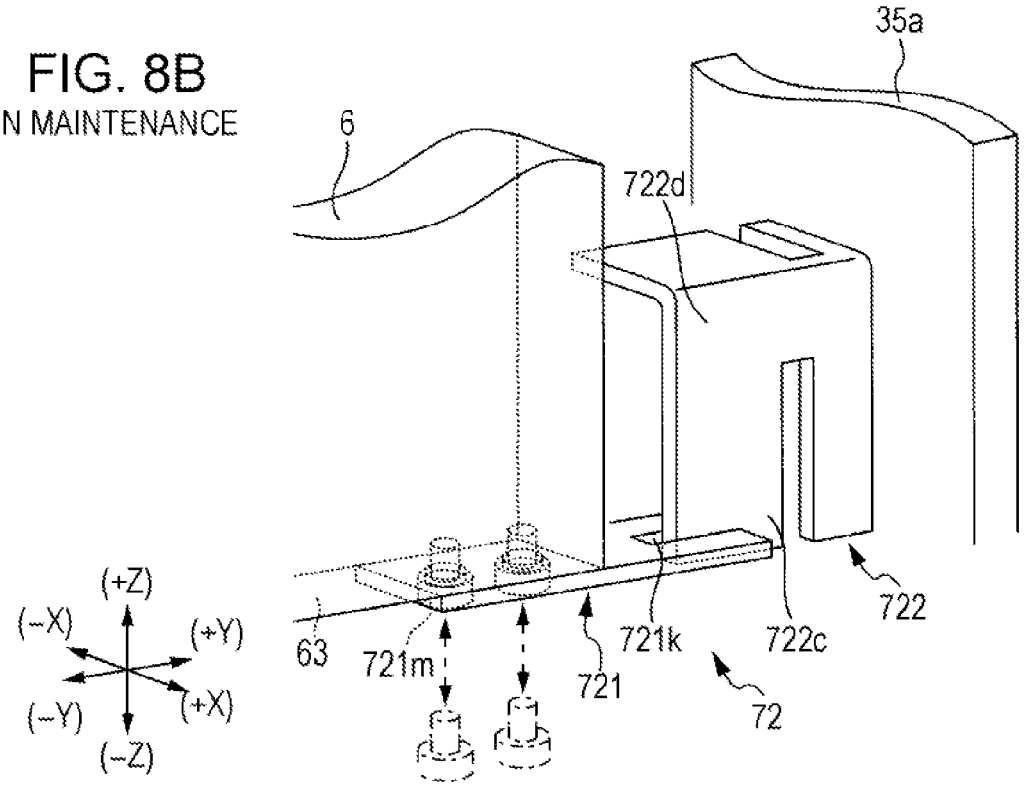

FIGS. 8A and 8B are partial perspective views illustrating a second embodiment of the printing apparatus according to the invention. The most different point between the second embodiment and the first embodiment is a configuration of the second guiding mechanism, and other configurations thereof are the same. Therefore, the following description will concentrate on the configurational difference. The same reference numerals and same signs are given to the same configurations and the description thereof will not be repeated.

The difference between the first embodiment and the second embodiment is that installation positions of a plate spring portion, a rigid portion, and a slit portion are changed. That is, in the second embodiments, a plate spring portion 722*c*, and a rigid portion 722*d* are provided in the fixed plate 722. Furthermore, a slit portion 721*k* to which the plate spring portion 722*c* and the rigid portion 722*d* of the fixed plate 722 can be fitted is provided on the movable plate 721. The fixed plate 722 is fixed to a (−Y) side surface of the frame member 35*a*, as illustrated in FIGS. 8A and 8B. A slit 722*e* extending in the up-down direction Z is provided on a part of the fixed plate 722, and thus the plate spring portion 722*c* is formed. In addition, the rigid portion 722*d* is formed above the plate spring portion 722*c*. Meanwhile, the movable plate 721 is fixed, using a bolt 721*m*, to a lower surface 63 of the carriage 6 in a state where a (+Y) side end portion of the movable plate 721 protrudes from the (+Y) side end surface of the carriage 6. The slit portion 721*k* is provided on the (+Y) side end portion of the movable plate 721. A width of the slit portion 721*k* is slightly greater than a width of the fixed plate 722, as similar to the slit portion 722*b* of the first embodiment. The plate spring portion 722*c* and the rigid portion 722*d* of the fixed plate 722 can be fitted to the slit portion 721*k*.

When the printing operation is performed in the second embodiment, the rigid portion 722*d* of the fixed plate 722 is fitted to the slit portion 721*k* of the movable plate 721, as illustrated in FIG. 8A. Therefore, positional deviation of the carriage 6 is prevented from occurring during the printing operation, and thus it is possible to perform printing processes in a state where the head 36 is stationary. As a result, it is possible to perform printing with a high level of accuracy.

Meanwhile, when the carriage 6 is positioned at the non-printing position so as to receive maintenance, a portion which is fitted to the slit portion 721*k* of the movable plate 721 is switched from the rigid portion 722*d* to the plate spring portion 722*c*, as illustrated in FIG. 8B. Thus, even when surface accuracy or positional accuracy of the carriage 6 does not satisfy the accuracy required for the use of the first guiding mechanism 71, the accuracy difference can be absorbed by a spring-like property of the plate spring portion 721*h*. Therefore, the accuracy required for assembling or the accuracy of components can be reduced, and thus the apparatus can be prevented from increasing in cost. Furthermore, even when an external force is applied to the head 36 or the carriage 6, the external force is absorbed by a biasing force of the plate spring portion 722*c*. Thus, the head 36 or the carriage 6 can be prevented from being greatly deviated from an initial position thereof. As a result, it is possible to effectively prevent a failure or damage of the apparatus.

The carriage moving mechanism 7 of the second embodiment can be assembled by following a simple procedure. First, the fixed plate 722 is temporarily fixed to the frame member 35*a* in advance. Then, the sliders 712 and 713 of the first guiding mechanism 71 which is mounted on the carriage 6 are positioned at and fixed to the frame member 35*b*, in a state where the movable plate 721 is not yet mounted. Accordingly, mounting of the first guiding mechanism 71 is finished. Subsequently, in a state where the mounting of the first guiding mechanism 71 is finished, the fixed plate 722 is fitted to the slit portion 721*k* of the movable plate 721 so as to finish assembling of the second guiding mechanism 72. Next, the movable plate 721 is fixed, using the bolt 721*m*, to the lower surface 63 of the carriage 6, in a state where the carriage 6 is positioned around the printing position (see FIG. 8A). Therefore, mounting of the second guiding mechanism 72 is completed, and thus the carriage 6 is movable in the up-down direction Z in a state where the carriage 6 is guided by two guiding mechanisms 71 and 72.

The only difference between the first embodiment and the second embodiment is that the installation positions of the plate spring portion, the rigid portion, and the slit portion are changed. Furthermore, a basic operation of the second embodiment is the same as the operation of the first embodiment, and thus the same operation effect can be achieved.

In the second embodiment, the fixed plate 722 corresponds to an example of a "third guide member" of the invention, and the plate spring portion 722*c* and the rigid portion 722*d* of the fixed plate 722 respectively function as the "spring portion" and the "rigid portion" of the invention. Furthermore, the movable plate 721 corresponds to an example of the "fourth guide member" of the invention.

The invention is not limited to the embodiments described above. Members of the embodiments described above can be used in combination or can be changed as long as they do not depart from the spirit of the invention. For example, in the embodiments described above, the guide rail 711 constituting the first guiding mechanism 71 is fixed to the carriage 6 and the sliders 712 and 713 are fixed to the frame member 35*b*. The guide rail 711 may be fixed to the frame member 35*b* and the sliders 712 and 713 may be fixed to the carriage 6.

Furthermore, in the embodiments described above, the guide rail 711 of the first guiding mechanism 71 is fixed to the rear side surface 61 of the carriage 6 and the movable plate 721 of the second guiding mechanism 72 is fixed to the (+X) side surface 62 of the carriage 6. Although the guide rail 711 and the movable plate 721 are fixed to the different surface, these members may be fixed to the same surface of the carriage 6 and constitute the carriage moving mechanism 7.

In the embodiments described above, the platen 30 and the maintenance unit 5 are arranged, in terms of a plan view, at the different position in the perpendicular direction Dp perpendicular to the transporting direction Ds. However, the positional relationship between the platen 30 and the maintenance unit 5 is not limited thereto and is optional.

In the embodiments, a plane-shaped support surface of the platen 30 supports the paper sheet S. However, the paper sheet S may be supported by a rotating drum having, for example, an arc-shaped support surface.

In the embodiments described above, the invention is applied to the printing apparatus 1 in which one head unit 3U is constituted by a plurality of integrally configured heads 36.

However, an application object of the invention is not limited thereto and the invention can be applied to a printing apparatus that has, for example, a configuration in which a plurality of head units 3U is provided and the head 36 is provided to each head unit 3U or a configuration in which the head unit 3U is not provided and each head 36 moves directly to the respective positions P1, P2, and P3.

The entire disclosure of Japanese Patent Application No. 2013-063550, filed Mar. 26, 2013 is expressly incorporated by reference herein.

What is claimed is:

1. A printing apparatus comprising:

a supporting member that supports a recording medium;

a head that discharges liquid onto the recording medium that is supported by the supporting member;

a carriage that holds the head;

a frame member that movably supports the carriage; and a carriage moving mechanism that moves the carriage between a printing position at which printing is performed by the head and a non-printing position which is different from the printing position, wherein the carriage moving mechanism has a first guiding mechanism that guides the movement of the carriage relative to the frame member, a second guiding mechanism that is arranged at a position different from that of the first guiding mechanism and guides the movement of the carriage relative to the frame member, and a driving mechanism that drives the carriage in the discharging direction, and wherein a distance by which the carriage is able to move in a second direction different from the discharging direction at the non-printing position through the use of the second guiding mechanism is greater than a distance by which the carriage is able to move in the second direction through the use of the first guiding mechanism and the second guiding mechanism in the printing position.

2. The printing apparatus according to claim 1, wherein the first guiding mechanism has a first guide member which is fixed to one of the carriage and the frame member and guides a movement of the carriage in the liquid discharging direction and a second guide member which is fixed to the other of the carriage and the frame member and which is movable in the discharging direction in a state where the second guide member is engaged with the first guide member, relative to the first guide member, wherein the second guiding mechanism has a third guide member which is fixed to one of the carriage and the frame member and guides a movement of the carriage in the discharging direction and a fourth guide member which is fixed to the other of the carriage and the frame member and which is movable in the discharging direction in a state where the fourth guide member is engaged with the third guide member, relative to the third guide member, and wherein the third guide member has a spring portion having a spring-like property and the fourth guide member is engaged with the spring portion when the carriage is positioned at the non-printing position.

3. The printing apparatus according to claim 2, wherein the third guide member has a rigid portion having a spring-like property lower than that of the spring portion and the fourth guide member is engaged with the rigid portion when the carriage is positioned at the printing position.

4. The printing apparatus according to claim 2, wherein the first guide member is a linear rail that extends in the discharging direction and the second guide member is a slider that moves along the linear rail.

5. The printing apparatus according to claim 2, wherein a fixing surface on the carriage, to which one of the first guide member and the second guide member is fixed, and a fixing surface on the carriage, to which one of the third guide member and the fourth guide member is fixed, are the same fixing surface.

6. The printing apparatus according to claim 2, wherein a fixing surface on the carriage, to which one of the first guide member and the second guide member is fixed, and a fixing surface on the carriage, to which one of the third guide member and the fourth guide member is fixed, are different fixing surfaces.

* * * * *